US006443755B1

(12) United States Patent
Beukes et al.

(10) Patent No.: US 6,443,755 B1
(45) Date of Patent: Sep. 3, 2002

(54) TRUNK LINE CONNECTOR

(75) Inventors: Christo Andre Beukes, Moreleta Park; Stephen Benedict Barker, Craighall, both of (ZA)

(73) Assignee: Expert Explosives (Proprietary) Limited, Modderfontein (ZA)

( * ) Notice: Subject to any disclaimer, the term of this patent is extended or adjusted under 35 U.S.C. 154(b) by 0 days.

(21) Appl. No.: 09/720,867

(22) PCT Filed: Jul. 1, 1999

(86) PCT No.: PCT/AU99/00535

§ 371 (c)(1),
(2), (4) Date: Mar. 12, 2001

(87) PCT Pub. No.: WO00/02288

PCT Pub. Date: Jan. 13, 2000

(30) Foreign Application Priority Data

Jul. 2, 1998 (ZA) ..... 98/5800

(51) Int. Cl.[7] ..... H01R 4/24
(52) U.S. Cl. ..... 439/402; 439/405
(58) Field of Search ..... 439/403, 397, 439/404, 405, 408, 410, 401, 402

(56) References Cited

U.S. PATENT DOCUMENTS

| | | | | | |
|---|---|---|---|---|---|
| 4,461,528 | A | * | 7/1984 | Durand et al. | 439/409 |
| 4,684,195 | A | * | 8/1987 | Anderson et al. | 439/404 |
| 4,834,669 | A | * | 5/1989 | Siemon et al. | 439/395 |
| 5,009,612 | A | | 4/1991 | Rishworth et al. | 439/403 |
| 5,199,899 | A | * | 4/1993 | Ittah | 439/403 |
| 5,435,747 | A | * | 7/1995 | Franckx et al. | 439/409 |
| 5,759,065 | A | | 6/1998 | Hatagishi | 439/596 |
| 5,961,341 | A | | 10/1999 | Knowles | 439/403 |

FOREIGN PATENT DOCUMENTS

| | | |
|---|---|---|
| AU | 34210/97 | 2/1998 |
| AU | 78996/98 | 1/1999 |
| DE | 43 06 868 C1 | 8/1994 |
| EP | 0 825 678 A2 | 2/1998 |
| FR | 2 253 290 | 11/1973 |
| FR | 2253290 | 6/1975 |

OTHER PUBLICATIONS

Derwent Abstract Accession No. 97–151617/14, Class V04 JP 09–027356 A (SUMITOMO DENSO KK) 28 Jan. 1997.

* cited by examiner

*Primary Examiner*—Tulsidas Patel
(74) *Attorney, Agent, or Firm*—Pillsbury Winthrop LLP

(57) ABSTRACT

A connector which includes two components, hinges which connect the components together and which allow the relative movement of the components, and terminals on one connector to which at least a branch line conductor and a trunk line conductor are electrically connectable. The connector also has catch means which enables the two components to be secured to each other with a snap action with one component overlying the other component, and a tab for releasing the catch means which extend over the branch line when the components are secured to each other.

8 Claims, 3 Drawing Sheets

TRUNK LINE CONNECTOR

BACKGROUND OF THE INVENTION

This invention relates to a connector which is suitable for use in making a branch connection to a trunk line for example in the manner which is required in a blasting system. The scope of the invention is however not confined to this application.

Connections to establish a blasting system are often made under difficult conditions. For example in an underground location lighting may be poor and accessibility may be limited. It is not always possible to make branch connections to a trunk line beforehand and in many instances such connections are made on site. The person making the connections may, in many cases, be guided more by feel than by sight and a connector which is usable in this way is therefore desirable.

A second factor which is important, particularly in poor lighting conditions, is the need to determine that a physical connection of the branch line to the trunk line has been made and that the connector has been correctly assembled. A connector which facilitates this determination is also desirable.

SUMMARY OF THE INVENTION

The invention provides a connector which includes a first component, conductive terminal means which is mounted to the first component and to which, in use of the connector, first conductor means which traverses the first component are connectable and second conductor means which extends from the first component at a defined location are connectable, a second component, hinge means which connects the first component to the second component so that the second component is movable from a first position at which the terminal means is exposed to a second position at which the second component overlies the first component and covers the terminal means, and catch means on the second component for releasibly securing the second component in the second position to the first component, wherein the catch means includes a tab which extends away from the second component and which is positioned so that in use it extends over the second conductor means at the defined location.

The catch means may be of any appropriate type and preferably has a flexible nature so that it is distorted as the second component is moved to the second position and, when the second component reaches the second position, the catch means is restored to its original non-distorted configuration due to its inherent resilience or memory.

The connector may be made from any suitable material and preferably is made from an appropriate plastics material with the desired qualities of toughness and resilience.

The tab may extend from a neck which projects from the second component and a hook formation may extend from the neck, preferably in an opposite direction to the direction in which the tab extends.

The second component may include any appropriate formation with which the hook formation is engageable. The first component may for example include an undercut formation such as a rib with which the hook is engageable.

The components may include respective surfaces which are brought into intimate abutting engagement with each other when the second component is moved to the second position. As has been indicated the second component is engaged with the first component at the second position preferably with a snap action which is generated by the catch means. This snap action ensures that the said surfaces are brought into abutting engagement with sufficient force to ensure that an audible sound is generated. To enhance this sound the invention, in a preferred embodiment, provides that at least one of the components includes at least one resonating chamber. The audible sound, which may be in the nature of a percussive click, is then generated and enhanced by the resonating or reverberating chamber.

Also according to the invention, there is provided a connector which includes two components, hinge means which connects the components together and which allows relative movement of the components, terminal means on one connector to which at least a branch line conductor and a trunk line conductor are electrically connectable, catch means which enables the components to be secured to each other with a snap action and with one component overlying the other component, and a tab, for releasing the catch means, which extends over the branch line conductor when the components are secured to each other.

The invention also provides a method of electrically connecting a trunk line conductor to a branch line conductor which includes the steps of electrically connecting the trunk and branch line conductors to a terminal, and enclosing the terminal inside two components which are interengageable with a snap action which simultaneously causes the generation of an audible sound.

BRIEF DESCRIPTION OF THE DRAWINGS

The invention is further described by way of example with reference to the accompanying drawings in which.

DESCRIPTION OF PREFERRED EMBODIMENT

Figure 1:
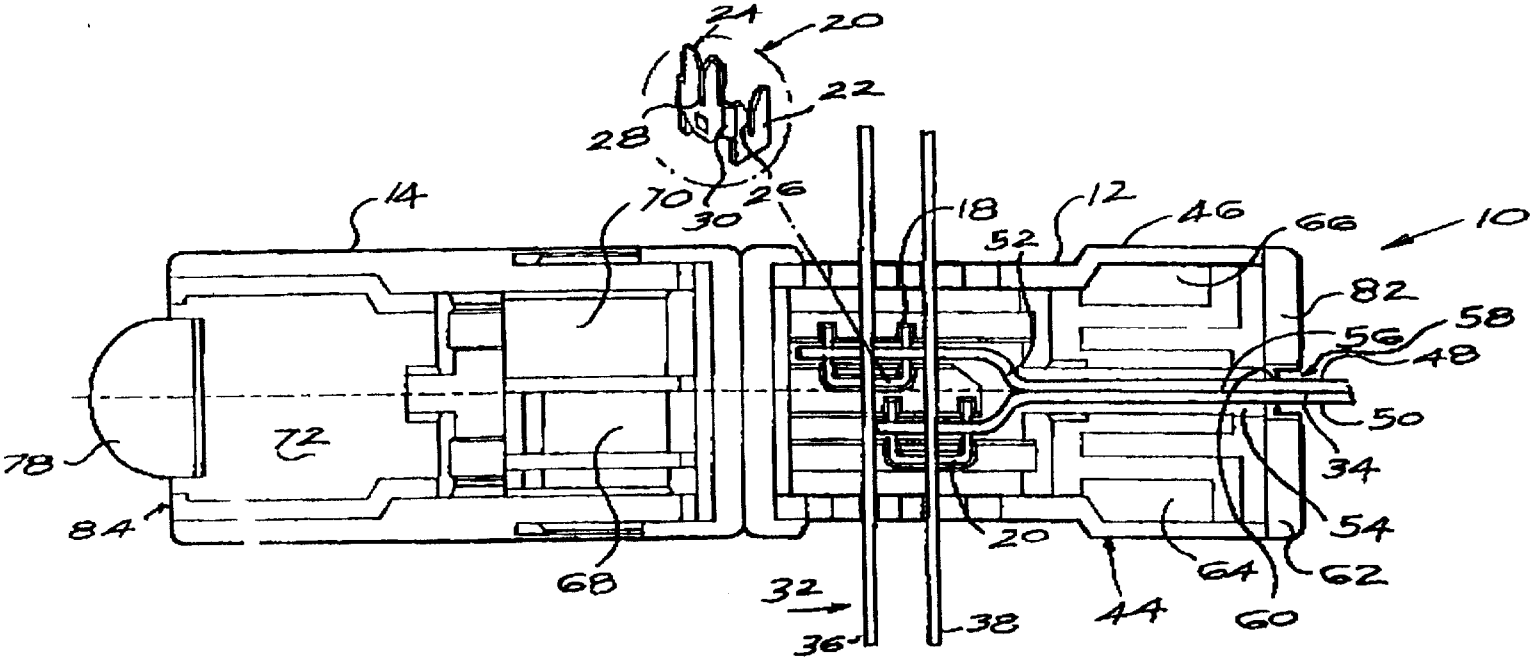
FIG. 1 is a plan view of a connector according to the invention.

The accompanying drawings illustrate a connector 10 according to the invention which is made from a suitable plastics material with desired qualities such as electrical resistivity, toughness, resilience and cost. The connector is manufactured using an injection moulding process by making use of techniques which are known in the art and which are consequently not further described herein.

The connector includes a first half-section or component 12, a second half-section or component 14, a hinge 16 which connects the second component to the first component, and two terminal posts 18 and 20 respectively.

The hinge 16 is constructed in a known manner essentially by forming a bridging section between the first and second components from relatively thinner and hence weakened material so that the bridging section is flexible. The hinge permits the second component 14 to be moved from a first position shown in FIG. 2 at which the connector is fully open and the terminal posts 18 and 20 are exposed to a second position, shown for example in FIG. 5, at which the second component overlies the first component and is securely engaged therewith.

Each terminal post 18, 20 is formed from suitable conductive sheet metal and for example has the shape shown in the inset drawing to FIG. 1. Viewed in plan the terminal post has a U-shape and opposing limbs 22 and 24 are formed with insulation displacement slots 26. A similar insulation displacement slot 28 is formed in a base 30 which extends between the limbs 22 and 24. Insulation displacement slots of this type are known in the art and are not described in detail herein. It is pointed out though that an insulated electrical conductor of an appropriate size can be electrically connected to the terminal posts simply by pushing the connector into one or more of the slots. When this action takes place the insulation on the electrical conductor is displaced and the bared electrical conductor is thereby brought into electrical contact with the terminal posts.

The terminal posts 18 and 20 are mounted in the first component 12 with the respective slots 26 and 28 facing upwardly.

FIG. 1 illustrates a trunk line 32 and a branch line 34 connected to the terminal posts. The trunk line 32 includes two conductors 36 and 38 respectively which pass through opposed slots 40 and 42 in the side walls 44 and 46 of the first component. The conductors 36 and 38 are respectively engaged with the slots 28 in the terminal posts 18 and 20 and hence are thereby electrically connected to the terminal posts. The branch line 34 also includes two conductors which are designated 48 and 50. These conductors are respectively connected to the terminal posts 18 and 20 by engaging the conductors with the two slots 26 in each respective terminal post. The conductors 48 and 50 are flared at a location 52 and then brought together so that they are positioned within opposing walls 54 of a channel 56. The trunk line exits the first component 12 at a location 58 which is defined or formed by an opening 60 in an end wall of the first component.

Hollow chambers 64 and 66 are formed in the first component and are respectively positioned on opposing sides of the channel 56.

Figure 5:
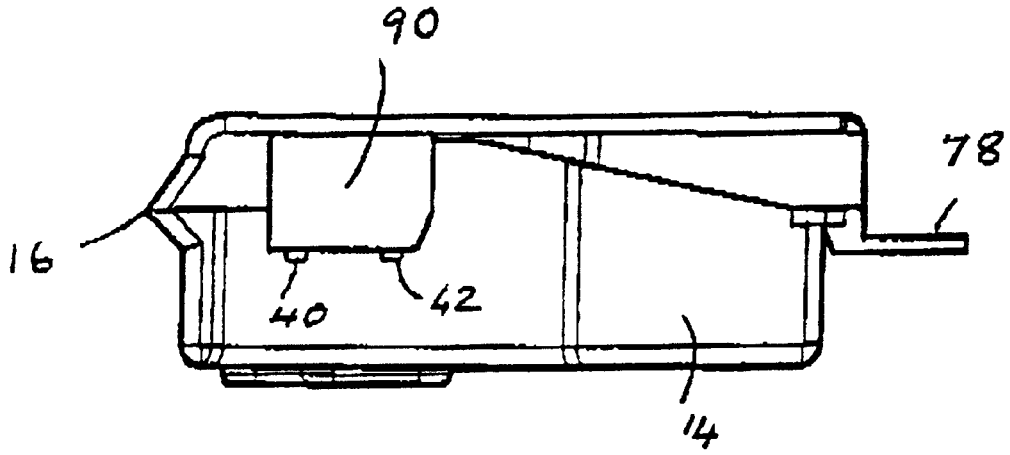
FIG. 5 is a side view of the connector fully closed i.e. in a position which is referred to herein as a second position.
Figure 6:
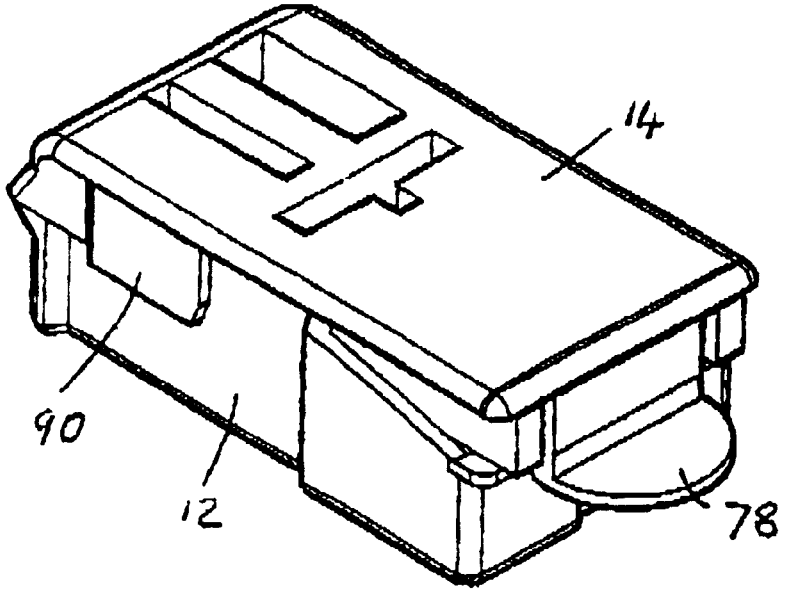
FIG. 6 is a perspective view of the connector in the said second position.

The second component 14 has protrusions 68 and 70 which are shaped so that when the second component is engaged with the first component at the second position as shown in FIG. 5 the protrusions bear against upper surfaces of the conductors 36, 38, 48 and 50, forcing the conductors downwardly into the first component, and providing a secure frictional lock between the conductors and the connector.

A relatively large hollow chamber 72 is formed in the second component to one side of the protrusions 68 and 70.

A catch formation 74 is provided on the second component. The catch formation includes a relatively short neck 76, a tab 78 which projects outwardly from the neck and a hook 80 which extends inwardly from the neck in an opposite direction to which the tab 78 extends.

As is evident particularly from FIG. 1 the first component 12 has an outwardly extending flange 82 which is formed in two sections located respectively on opposing sides of the location 58 and this flange provides a slightly flexible undercut formation with which the hook is engageable, as is shown in FIG. 5.

The geometry and design of the connector are such that when the second component is engaged with the first component in the second position shown in FIG. 5 at least two opposing surfaces which are located respectively on the first and second components are brought into close abutting relationship. For example upper surfaces 82A of the flange 82 are brought into close contact with opposing surfaces 84 on the second component. In a similar way a number of surfaces on the second component are brought into close abutting relationship with respective opposing surfaces on the first component.

In many cases the branch line 34 is connected to the connector prior to assembly of the connector on site. If this is not the case then the branch line is connected on site to the connector in the manner which has been described.

Figure 2:
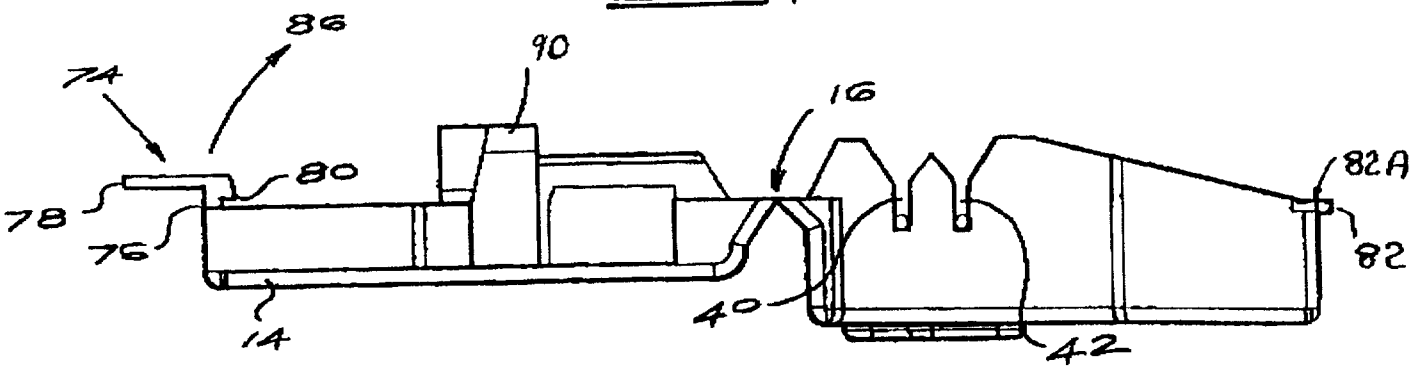
FIG. 2 is a side view of the connector of FIG. 1 in an open position which is referred to herein as a first position.
Figure 3:
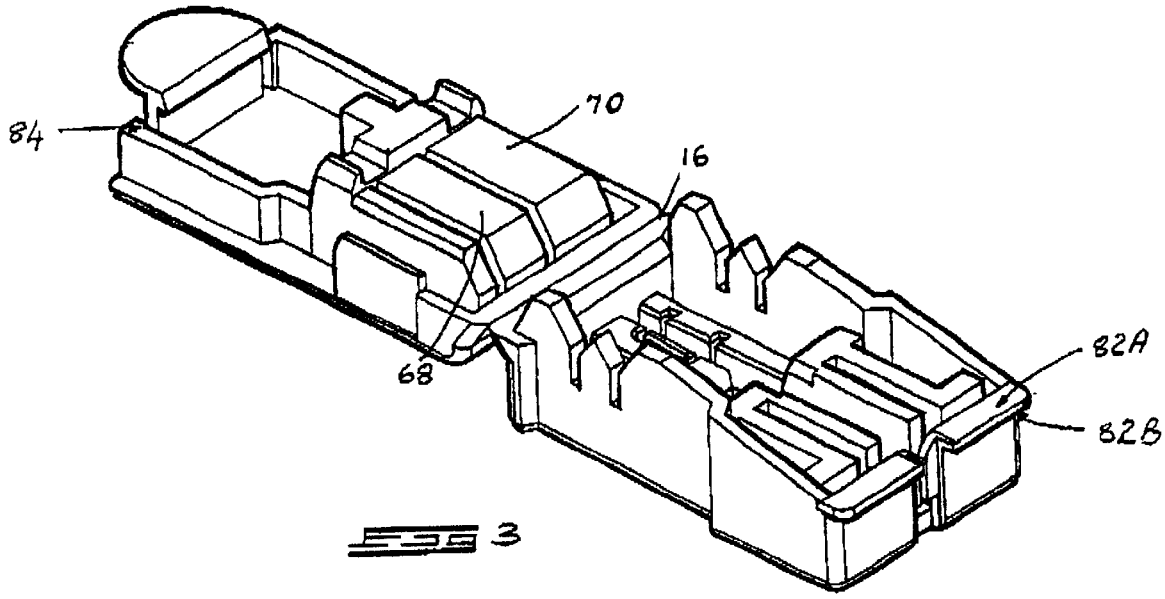
FIG. 3 is a perspective view of the connector fully open i.e. in the first position.

The electrical conductors 36 and 38 are passed through the slots 40 and 42, as shown in FIG. 2, and are pushed downwardly so that they enter the slots 28 on the terminal posts 18 and 20. The second component is then pivoted upwardly in the direction of an arrow 86, see FIG. 2, relatively to the first component, with the pivotal movement taking place about the hinge 16.

Figure 4:
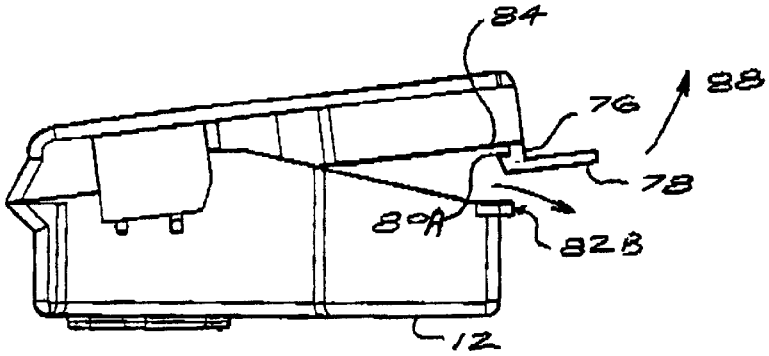
FIG. 4 is a side view of the connector in a substantially closed configuration.

FIG. 4 illustrates the connector in a substantially closed configuration. The protrusions 68 and 70 bear against upper surfaces of the conductors inside the first component and urge the conductors downwardly deeper into the first component, thereby establishing a good frictional lock between the conductors and the connector.

As the second component is moved from the FIG. 4 position to the FIG. 5 position the hook 80 bears against outer upper corners of the sections of the flange 82. The catch 74 is deflected outwardly and upwardly in the direction of an arrow 88, see FIG. 4, with this movement being allowed for by flexing of the neck 76. Once the upper surfaces of the flange 82 are in contact with the opposing surfaces 84 on the second component the neck, due to its inherent resilience, moves from its distorted position forcing the hook into engagement with the flange, as shown in FIG. 5.

The neck 76, when distorted, acts as a loaded spring. The hook 80 has an outermost tip 80A, see FIG. 4, which passes over an outer edge 82B of the flange 82. When the tip reaches the lower side of the edge 80B the neck 76 springs back to a non-distorted shape rapidly urging the two components together.

The engagement of the second component with the first component thus takes place with a snap action which arises due to the distortion, and then restoration to its original shape, of the catch 74. The two components are thereby brought into the second position shown in FIG. 5 in an abrupt and quick manner and opposing surfaces of the components, e.g. the surfaces 82A and 84, are moved quickly into contact with each other. This action generates an audible sound in the nature of a percussive click and the sound is enhanced by the hollow chambers 64, 66 and 72 which act in the manner of reverberating or resonating chambers. A distinct audible click is thereby generated which acts as a notification to the operator that the connector has been securely closed.

As the connector closes flaps 90 on opposing sides of the component 14 partly overlie the slots 40 and 42 in the component 12 and thereby bend the projecting portions of the conductors 36 and 38 downwardly, increasing the mechanical fixing of the conductors to the connector.

The catch 74 extends outwardly from the second component and is positioned so that it overlies the branch line 34 at the location 58. The operator is therefore able, acting only by touch, and by using a hand, to trace the branch line 34 to the connector. When the connector is reached the tab is simultaneously touched for the tab 78 extends over the conductor 34. The tab may be flexed upwardly, relatively to the first component, to bend the neck 76 and move the hook out of engagement with the flange, if this is desired.

The positioning of the tab in the manner described and the audible percussive click which is generated when the two components of the connector are interengaged carry significant benefits in that they simplify the use of the connector on site particularly in difficult conditions for they enable an operator, substantially relying on touch only, to make a secure electrical connection between branch and trunk lines and, where necessary, to verify that such connections have, in fact, been made.

What is claimed is:

1. A connector comprising a first component, conductive terminal means which is mounted to the first component and to which, in use of the connector, first conductor means which traverses the first component are connectable and second conductor means which extends from the first component at a defined location are connectable, a second component, hinge means which connects the first component to the second component so that the second component is movable from a first position at which the terminal means is exposed to a second position at which the second component overlies the first component and covers the terminal means, and catch means on the second component for releasibly securing the second component in the second position to the first component, wherein the catch means includes a tab which extends away from the second component and which is positioned so that in use it extends over the second conductor means at the defined location.

2. A connector according to claim 1 wherein the catch means is resilient and, with the second component in the first position, has a non-distorted configuration, and wherein the catch means is distorted as the second component is moved to the second position and, when the second component reaches the second position, the catch means is restored to its non-distorted configuration due to its resilience.

3. A connector according to claim 1 comprising a neck which projects from the second component, and a hook formation and the tab extend from the neck in opposite directions.

4. A connector according to claim 3 wherein the first component includes an undercut formation with which the hook is engageable.

5. A connector according to claim 1 wherein the first and second components include respective surfaces which are brought, with a snap action, into intimate abutting engagement with each other when the second component is moved to the second position, with sufficient force to ensure that an audible sound is generated.

6. A connector according to claim 5 wherein at least one of the components includes at least one resonating chamber which at least enhances the said audible sound.

7. A connector comprising two components, hinge means which connects the components together and which allows relative movement of the components, terminal means on one connector to which at least a branch line conductor and a trunk line conductor are electrically connectable, catch means which enables the components to be secured to each other with a snap action and with one component overlying the other component, and a tab, for releasing the catch means, which extends over the branch line conductor when the components are secured to each other.

8. A method of electrically connecting a trunk line conductor to a branch line conductor using a connector as claimed in claim 1 comprising electrically connecting the trunk and branch line conductors to the terminal means of the connector, moving the second component of the connector from a first position at which the terminal means is exposed to a second position at which the second component overlies the first component and covers the terminal means, wherein the first and second components are interengageable with a snap action which simultaneously causes the generation of an audible sound.

* * * * *